United States Patent [19]

Polidoro

[11] Patent Number: 4,778,229

[45] Date of Patent: Oct. 18, 1988

[54] PIVOTAL LATCH

[76] Inventor: Albert V. Polidoro, 3327 N. Hartville St., Philadelphia, Pa. 19134

[21] Appl. No.: 886,837

[22] Filed: Jul. 16, 1986

Related U.S. Application Data

[63] Continuation-in-part of Ser. No. 559,278, Dec. 8, 1983, abandoned.

[51] Int. Cl.[4] ..... A47B 49/00

[52] U.S. Cl. ..... 312/326; 312/333; 292/202

[58] Field of Search ..... 312/333, 245, 282, 313; 292/202

[56] References Cited

U.S. PATENT DOCUMENTS

| | | | |
|---|---|---|---|
| 241,439 | 5/1881 | Steinmetz | 312/287 |
| 395,129 | 12/1888 | Gardner | 292/202 |
| 538,965 | 5/1925 | Allen et al. | 292/202 |
| 594,510 | 11/1897 | Arth | 5/187 |
| 2,801,868 | 8/1957 | Carson | 292/202 |

*Primary Examiner*—Joseph Falk

*Attorney, Agent, or Firm*—Steele, Gould & Fried

[57] ABSTRACT

A latch for latching a folding shelf having compartments to a cabinet having a pivotal cover is disclosed. A rectangular shelf stop downwardly projects from the transverse inner edge of the shelf and has a latch stop projecting forwardly of the shelf stop. The latch is affixed to a shaft which is pivotally supported in a holder mounted within the cabinet. To the shaft is affixed a handle for rotating the latch into engagement with and out of engagement with the shelf stop. When the handle is swung upwardly, it contacts a vertical handle position stop on the outer surface of the rear wall of the cabinet and the latch is pivotally moved by the shaft to the horizontal unlatched position. When the handle is swung downwardly, the latch contacts the shelf stop to secure the shelf in horizontal, latched position relative to the cabinet. The cabinet rear wall is configured to provide a handle access clearance space to facilitate pivotal movement of the handle for engaging and disengaging the latch.

1 Claim, 4 Drawing Sheets

FIG. 7
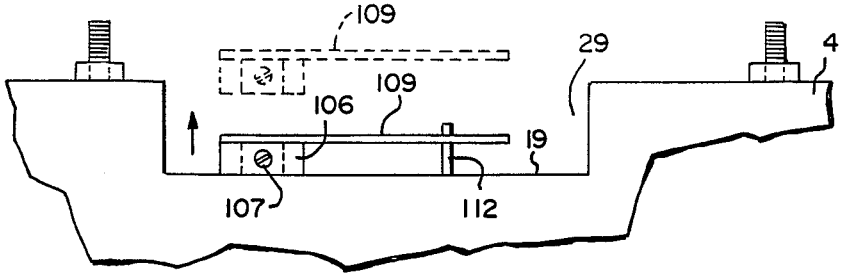
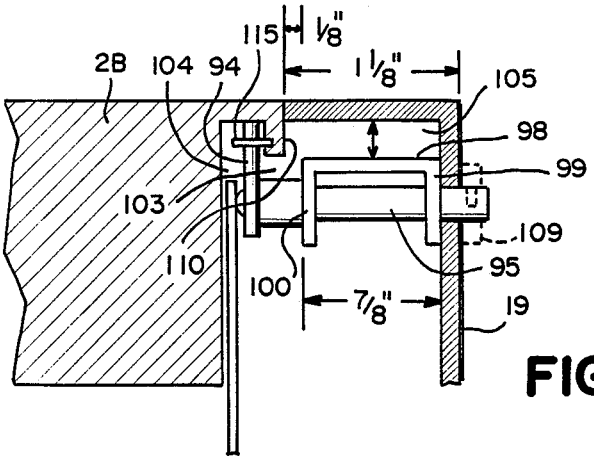
FIG. 8
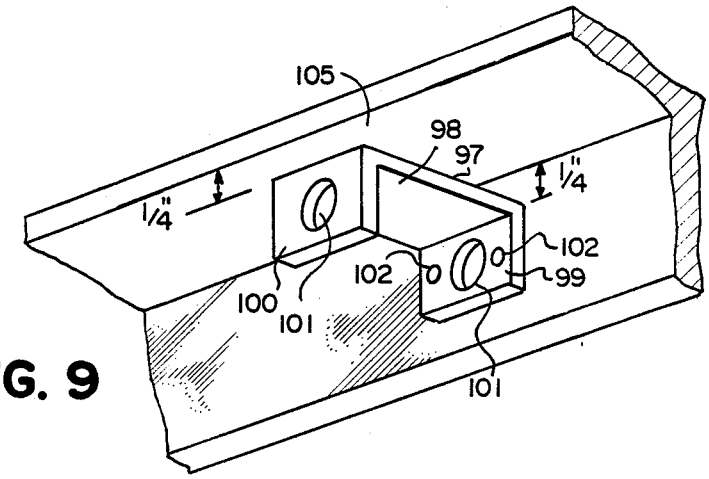
FIG. 9

PIVOTAL LATCH

RELATED APPLICATION

This application is a continuation-in-part of my copending application Ser. No. 559,278, filed Dec. 8, 1983, now abandoned.

BACKGROUND OF THE INVENTION

1. Field of the Invention

The present invention relates to a sturdy latch which is utilized to latch a folding shelf to a cabinet.

2. Description of the Prior Art

It is known to provide a folding shelf cabinet of the type having a pivotally attached cover. In U.S. Pat. No. 4,359,251, entitled "Folding Shelf Cabinet," which issued to the present applicant on Nov. 16, 1982, there was disclosed a decorative folding shelf cabinet suitable for storing small articles, such as small radios. The cabinet dislosed in U.S. Pat. No. 4,359,251 included an enclosure having an open front, a movable cover designed to overfit the open front and a movable shelf movably connected to the movable cover.

SUMMARY OF THE INVENTION

The present invention relates generally to the field of small cabinets, and more particularly, relates to a pivotal latch suitable to alternately latch and unlatch a folding shelf to a wall mounted cabinet.

The pivotal latch of the present invention comprises a holder secured in the shelf and having aligned openings therein. A latch shaft is rotatable within the openings to rotate a latch between latched and unlatched positions whereby the shelf may be releasably secured upon the cabinet.

BRIEF DESCRIPTION OF THE DRAWINGS

FIG. 7 is a partial top plan view of the top wall of the cabinet and illustrates the clearance space between the cabinet and the mounting wall; removal of the handle while the cabinet is mounted on a wall is shown in dashed lines.

FIG. 8 is a partial, sectional view of the right side of the cabinet and illustrates the pivotal latch assembly in cooperation with the cabinet and the pivotal cover, the latch being illustrated in pivotally latched position for latching the folding shelf to the cabinet.

FIG. 9 is a perspective view of the holder for pivotally supporting the latch, and shows the holder mounted on the rear wall within the cabinet.

DESCRIPTION OF THE PREFERRED EMBODIMENT OF THE INVENTION

Figures 1, 2:
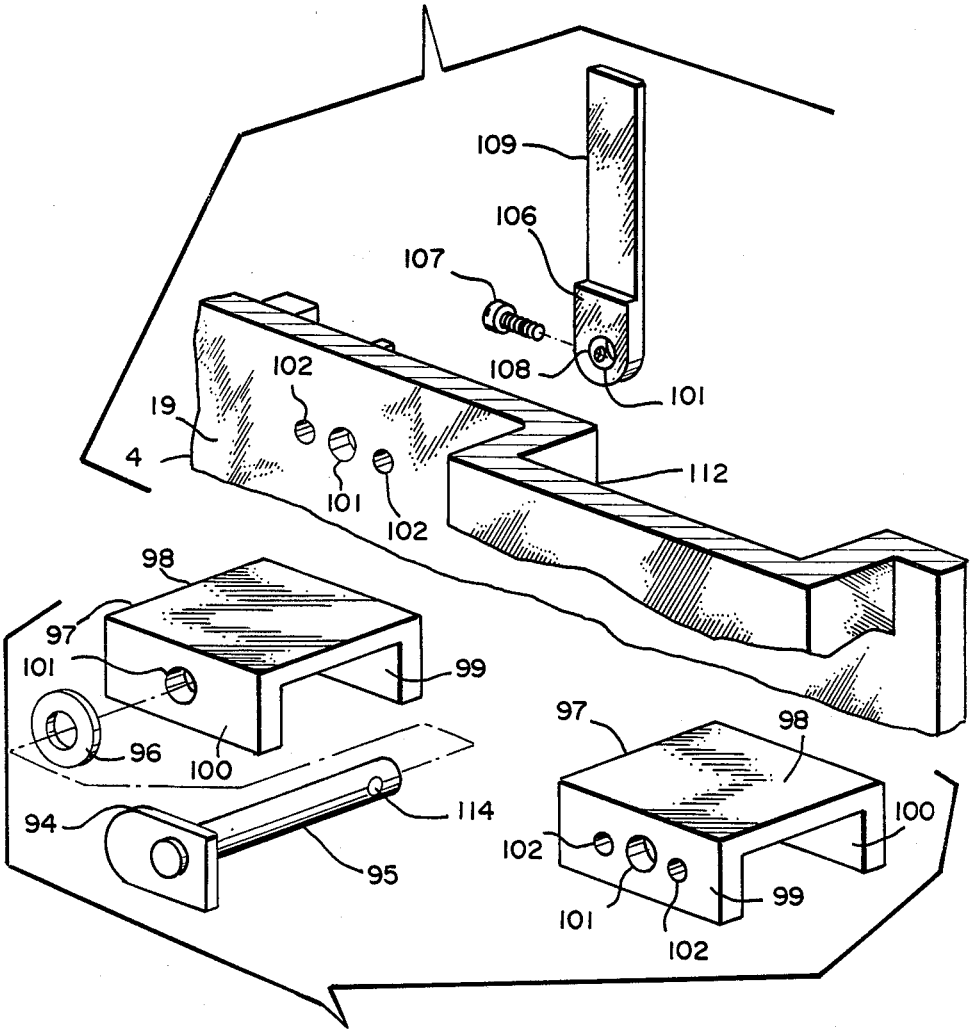
FIG. 1 is a partial, perspective, exploded view of the latch assembly in association with the rear vertical wall of the cabinet.
FIG. 2 is a perspective view of the holder looking from a direction one hundred and eighty degrees from the direction of view of FIG. 1.

A generally rectangular latch 94 shown in FIGS. 1, 2, 3, 4 having rounded corners in the top edge and having a flat side surface is preferable made of rigid molded plastic. The latch 94 is affixed on the forward end of an aluminum metal shaft 95 of round cross-sectional shape having dimensions 5/32 inches diameter by 1⅝ inches long. The shaft 95 is endwardly provided with a countersunk and threaded aperture 114 in central alignment with the vertically positioned latch 94. A washer 96 of suitable gauge and made of rigid molded plastic is provided on the shaft 95 and contacts the inner surface of the latch 94. It should be noted in this description that lightweight materials of construction are utilized in constructing the pivotal latch 94 and cooperative parts for providing a minimum of weight of materials of construction for cooperating with a folding shelf cabinet 4. Preferably, the cabinet 4 is a folding shelf cabinet as described in my earlier U.S. Pat. No. 4,359,251.

A generally channel-shaped holder 97 made of rigid molded plastic or other suitable lightweight material can be used to support the pivotal shaft 95 therethrough and comprises a top wall or web 98 and depending legs comprising a rear vertical wall 99 and a forward vertical wall 100. Pivotal access apertures 101 are respectively formed in alignment through the centers of the rectangular shaped rear vertical wall 99 and rectangular shaped forward vertical wall 100 of the holder 97 and through the rear vertical wall 19 of the cabinet 4 in a central upper part thereof. A clearance space 105 is defined between a stationary shelf and the top wall 98 of the holder 97 within the folding shelf cabinet 4 for mounting on a wall. Mounting screw access apertures 102 for mounting the holder 97 within the cabinet 4 are formed through the rear vertical wall 99 of the holder 97 in alignment and through the rear vertical wall of the cabinet 4, one of which is formed on each side of the pivotal access apertures 101. The shaft 95 is positioned through the holder 97 and has only slight clearance in the pivotal access apertures 101 so that the shaft 95 is pivotal in the pivotal access apertures 101 and a slight braking effect is provided. Mounting screws are shown in FIGS. 3, 4 in the apertures 102 for mounting the holder 97 on the rear vertical wall 19 within the cabinet 4, or other suitable means for mounting the holder 97 can be used.

The inner end part of the shaft 95 transversely projects through the rear vertical wall 19 of the cabinet 4, and the inner surface of the washer 96 contacts the forward surface of the forward vertical wall 100 of the holder 97. The washer 96 is utilized so that a shelf stop 110 is provided clearance access between the forward length-wise edge of the top wall of the cabinet 4 and the inner surface of the latch 94. A clearance space between the upper forward part of the cabinet 4 and the forward vertical wall of the pivotal cover 3 is provided for pivotal clearance of the cover 3. The clearance space is simultaneously cooperative and provides access clearance 104 for pivotally swinging the latch 94 and access clearance space 103 for access clearance of the shelf stop 110, and the latch stop 115. The inner end of the shaft 95 projects into the clearance space between the rear wall of the cabinet 4 and the mounting wall, whereby a handle 109 made of rigid molded plastic and thick base material of construction 106 is positioned. Sufficient clearance between the cabinet 4 and the rear wall is provided for the handle. A mounting screw 107 threaded in a threaded aperture 108 formed through one side of the pivotal end part thereof is threaded into the threaded aperture 114 that is countersunk and threaded in the shaft 95. The opposite end of the handle 109 is illustrated in FIG. 3 in horizontal alignment and contacts a horizontal handle position stop 112 which is made of rigid molded plastic and which projects from the outer surface of the rear vertical wall 19 of the cabinet 4. The horizontal handle position stop 112 is mounted adjacent to the handle access clearance slot 29 which is formed parallel with the handle 109 in a central upper part of the rear wall 19 and a part of the inner lengthwise edge of the top wall of the cabinet 4.

Figure 3:
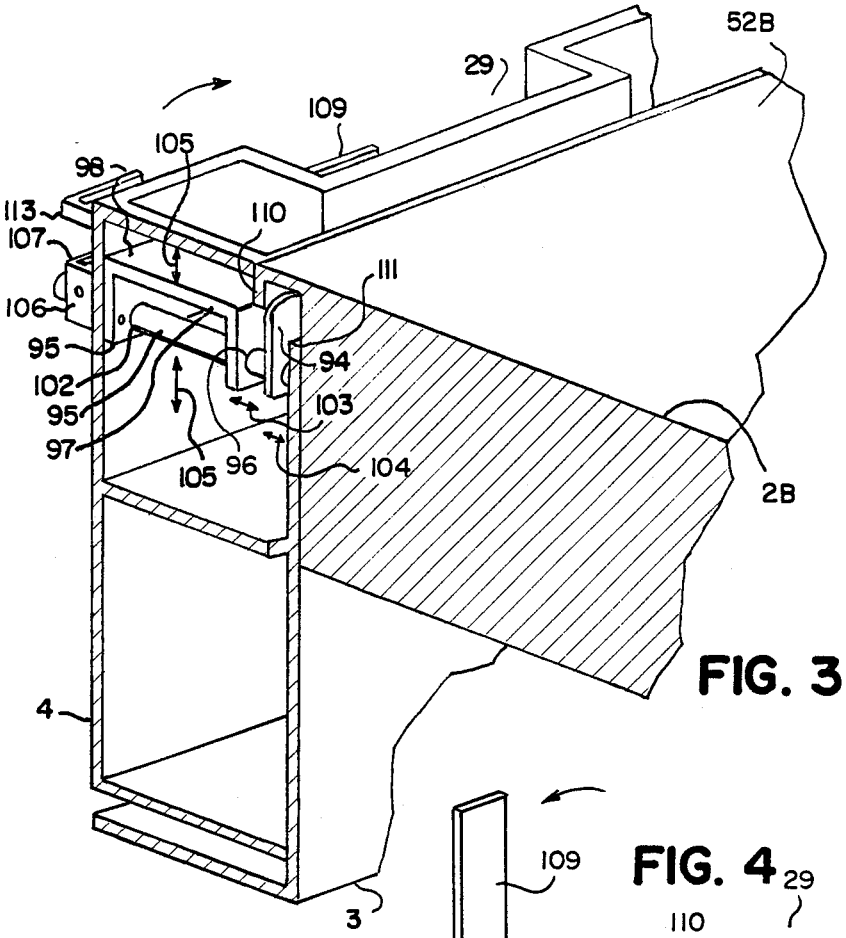
FIG. 3 is a perspective view of the pivotal latch in vertically latched position contacting a latch-stop and a shelf-stop, and partially broken away to expose interior construction details.
Figure 4:
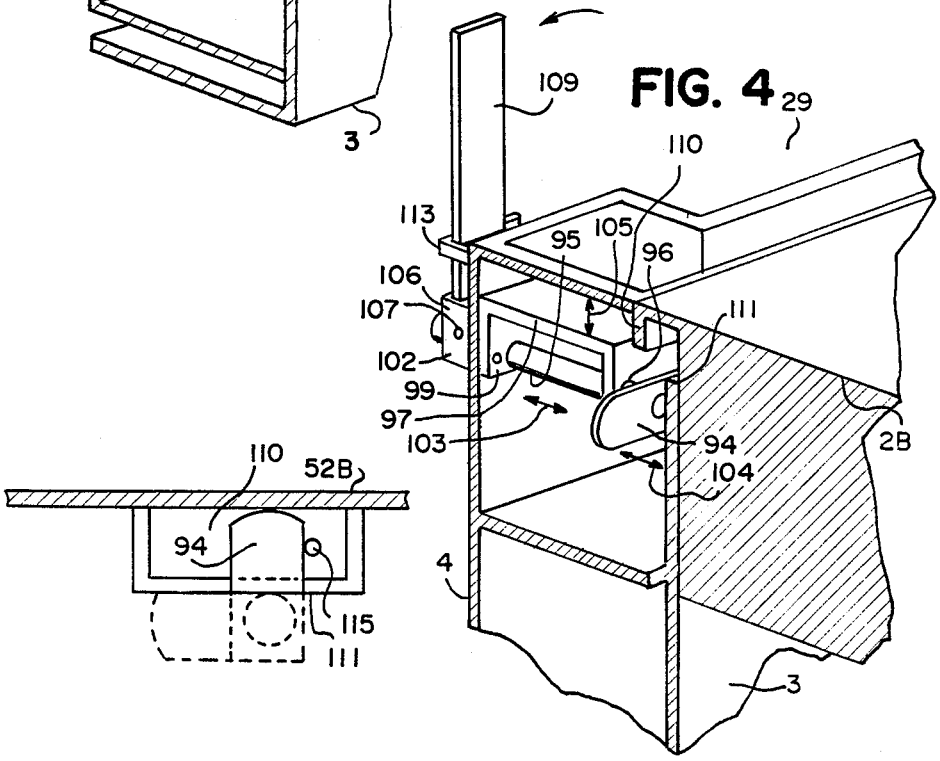
FIG. 4 is a partial, perspective view showing the pivotal latch in horizontal unlatched position and the handle contacting the vertical handle position stop.
Figure 5:
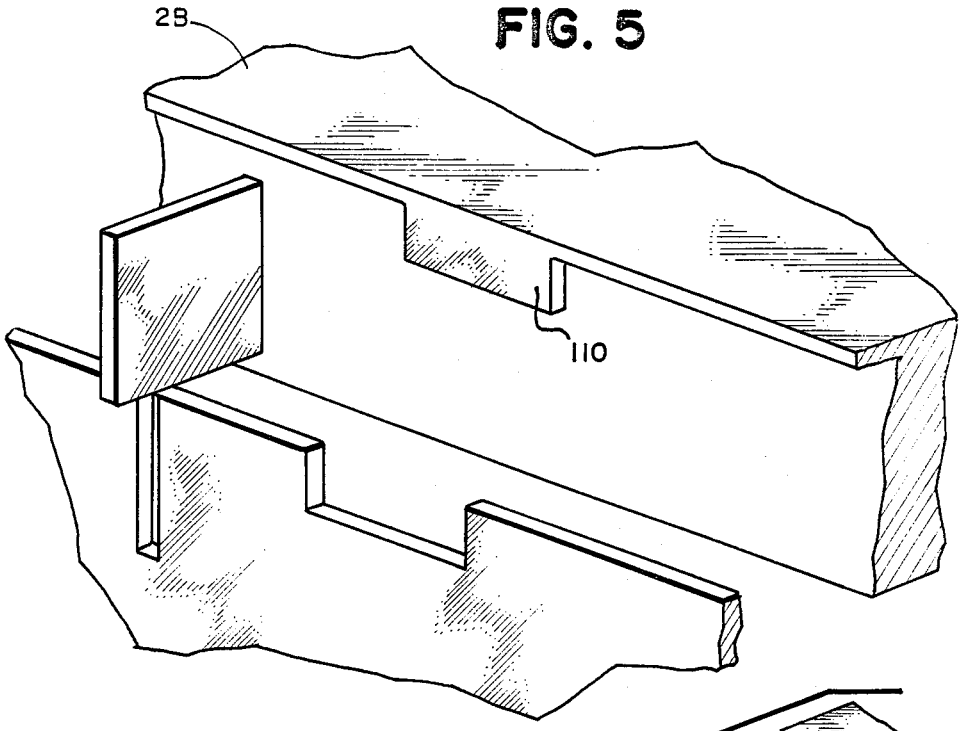
FIG. 5 is a partial perspective view of a central part of the folding shelf and illustrates the shelf-stop downwardly extending from the transversely projecting inner lengthwise edge of the folding shelf in alignment with the shelf-stop access clearance slot in the top lengthwise edge of the forward wall of the pivotal cover of the cabinet.
Figure 6:
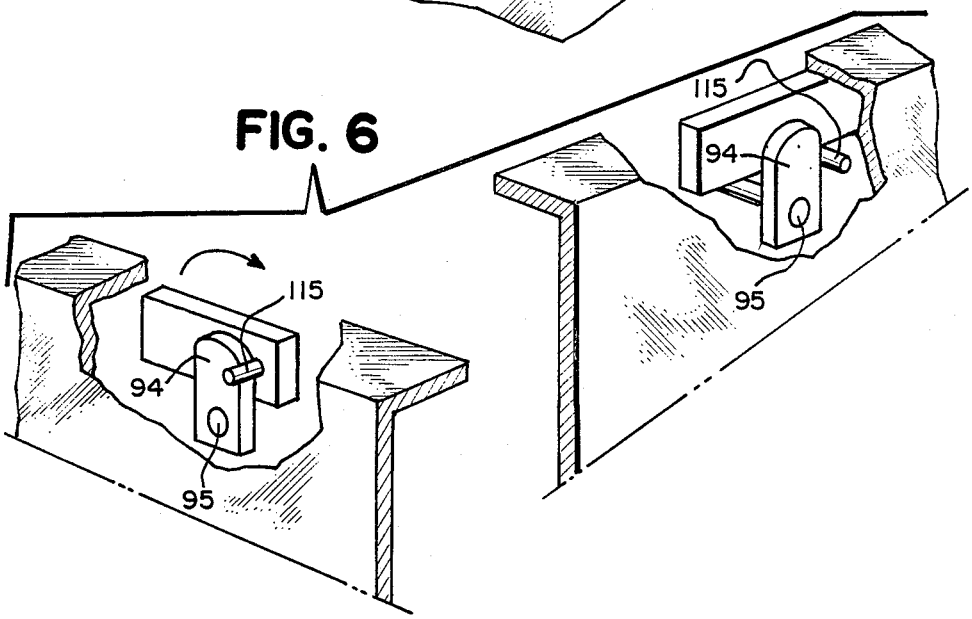
FIG. 6 shows two transparent views of the pivotal latch in vertically latched position and contacting the latch-stop.

A clearance space 105 is provided between a stationary shelf and the top wall within the cabinet 4 for mounting the holder 97 on the rear wall 19 within space 105 thereof, as shown in FIGS. 3, 4 and 9 of the drawings. The latch 94 is positioned in the clearance space 104 and has pivotal clearance in the clearance space between the upper forward part of the cabinet 4 and the forward wall of the pivotal cover 3 of the cabinet 4, thereby provided for clearance of the pivotal cover 3. The cover 3 of cabinet 4 comprises a downwardly extending slot 111 having a closed end and an open top formed in the top lengthwise edge of the forward wall of the cover 3. The slot 111 is cooperative with the pivotal latch 94 while simultaneously providing access clearance for the shelf stop 110 which is made of rigid molded plastic and downwardly projects from the transversely projecting inner lengthwise edge of the folding shelf 2B. The shelf stop 110 is rectangularly shaped and has a threaded aperture formed through a central part thereof adjacent to a vertical side edge thereof. The threaded aperture receives a threaded stud bolt made of metal and round in shape and having an unthreaded forward part, and comprises a latch stop threaded into the forward surface of the shelf-stop 110 so the the unthreaded forward part transversely projects from the forward surface of the shelf stop 110.

As the latch 94 is pivotally swung to the horizontally unlatched position by the user, (see FIG. 4), the handle 109 contacts the vertical handle position stop 113. As the user simultaneously pushes shelf 2B inwardly, the shelf-stop 110 is in alignment with the access clearance slot 111 in the top lengthwise edge of the cover 3 which provides access clearance for the shelf stop 110. The latch stop 115 being transient simultaneously through the slot 111 clears the cover 3 and the top lengthwise edge of the horizontally positioned latch 94 when in the pivotally swung horizontal unlatched position. As the transversely projecting inner lengthwise edge 52B of the shelf 2B contacts the forward lengthwise edge of the top wall of the cabinet 4, the shelf stop 110 downwardly projects into the clearance space 103 whereby the bottom edge of the shelf stop 110 terminates a slight distance above the washer 96. In this position, the shelf stop 110 is in horizontal alignment slightly above, parallel to, and adjacent the the inner surface of the top edge of the horizontally positioned latch 4.

As the handle 109 is pivotally swung downwardly, the shaft 95 pivotally swings the latch 94 to its vertically latched position, whereby the inner surface of the latch 94 starts contacting the forward surface of the shelf stop 110, therefore providing latching contact on the forward surface area of the shelf stop 110. This construction serves as an aid in preventing random pivotal motion of the latch 94 from the vertically latched position and is cooperative with the top edge of the latch 94. The top edge of the latch, is in horizontal alignment with the lengthwise edge of the bottom surface of the top wall of the cabinet 4, and the bottom surface of the transversely projecting inner lengthwise edge 52B of the folding shelf 2B is in horizontal alignment with the top edge of the latch 94. As the latch 94 is being pivotally swung to vertically latched position, (see FIG. 3), a first round shaped corner of the leading top edge of the latch 94 makes latching contact, and as the latch 94 is in the vertically latched position, the vertical edge of the latch 94 is adjacent to, and thereby contacts the latch stop 115, and the flat inner surface of the latch 94 simultaneously contacts the forward surface of the shelf stop 110 thereby provided for preventing the folding shelf 2B from being pulled forward of the cabinet 4 and the cover 3 while shelf 2B is latched to the cabinet 4.

The vertical walls of the compartments downwardly extend and terminate a slight distance beyond the closed end of the shelf stop access clearance slot 111. A novel feature of this invention being, that the pivotal latch 94 can be disassembled when repairs and/or replacement of the latch is necessary. After the user pivotally swings the cover 3 upwardly to the horizontally extended open position and after loosening the mounting screw 107 on the handle 109, the latch 94 assembly can be removed through the access clearance space 105 provided between the stationary shelf and the top wall within the cabinet 4 after loosening the mounting screws 102 from the rear wall 19 within the cabinet 4.

What is claimed is:

1. A latch for latching a shelf to a cover of a stationary cabinet, the cabinet being of the type having a rear wall, an open front and a movable cover designed to overfit the open front and the movable cover having a forward wall with a top lengthwise edge, comprising a generally rectangular, rigid molded plastic latch, the latch being rotatable relative to the cover between a latched position and an unlatched position;

a metallic shaft affixed at one end to the latch, the shaft having a handle affixed at its opposite end for rotating the latch, the shaft being reciprocally rotatable relative to the said cabinet rear wall through an arc of operation;

the shelf having an inner top lengthwise edge, and a shelf stop of generally rectangular shape downwardly extending from the said inner top lengthwise edge, the shelf stop being positioned to be contacted by the latch when the latch is rotated to its said latched position;

the metallic shaft being pivotally supported in a holder secured to the rear wall of the cabinet, the holder being made of rigid molded plastic, the holder comprising a top wall and downwardly extending forward and rear vertical walls, the vertical walls being provided with shaft access apertures therethrough, the rear cabinet wall being provided with a shaft access aperture in alignment with the holder access apertures, the holder being securely mounted on the rear wall of the cabinet by mounting screws, and the metallic shaft being supported in the aligned forward vertical wall, rear vertical wall and cabinet rear wall apertures to allow pivotal movement therein;

the rear wall of the cabinet being configured to define a clearance space rearwardly of the cabinet, a portion of the said handle being positioned to reciprocally rotate within the clearance space;

a pair of spaced handle stops projecting rearwardly from the rear cabinet wall, one handle stop being positioned to be contacted by the handle to stop the handle in a horizontal position and the other handle stop being positioned to be contacted by the handle to stop the handle in a vertical position, the handle contacting the handle stops to limit the rotative movement of the handle relative to the cabinet and to define an arc of operation of ninety degrees;

a latch stop horizontally projecting forwardly of the shelf stop, the latch stop being positioned so that the leading edge of the latch contacts the adjacent surface of the latch stop when the latch is swung to its latched position; and the top lengthwise edge of the forward wall of the cover being provided with a rectangularly shaped, downwardly extending slot, the slot being in alignment with and providing access clearance for the said shelf stop;

whereby, as the handle is swung upwardly, the latch is pivotally swung to its said unlatched position a predetermined distance below the lower end of the downwardly extending slot for unobstructed clearance of the shelf stop and the latch stop through said slot, as the folding shelf contacts the cabinet, the latch can be pivotally swung to its said latched position, and as the latch contacts the shelf stop, the latch will contact the adjacent part of the folding shelf whereby the folding shelf will be supported from the cabinet.

* * * * *